US005878314A

United States Patent [19]

Takaya et al.

[11] Patent Number: 5,878,314

[45] Date of Patent: Mar. 2, 1999

[54] IMAGE-FORMING DEVICE AND METHOD OF MANUFACTURING DIELECTRIC SHEET

[75] Inventors: Toshihiko Takaya, Yamatokoriyama; Shunju Anzai, Nara; Tomohiro Oikawa, Chiba, all of Japan

[73] Assignee: Sharp Kabushiki Kaisha, Osaka, Japan

[21] Appl. No.: 9,159

[22] Filed: Jan. 20, 1998

[30] Foreign Application Priority Data

Jan. 21, 1997 [JP] Japan ..... 9-008986

[51] Int. Cl.[6] ..... G03G 15/16

[52] U.S. Cl. ..... 399/302; 399/308; 264/45.4

[58] Field of Search ..... 399/302, 308, 399/313; 264/327, 45.4, 126

[56] References Cited

U.S. PATENT DOCUMENTS

| | | | |
|---|---|---|---|
| 3,476,841 | 11/1969 | Bienert | 264/45.4 |
| 5,143,664 | 9/1992 | Noguchi et al. | 264/113 |
| 5,390,012 | 2/1995 | Miyashiro et al. . | |
| 5,391,337 | 2/1995 | Kearney et al. | 264/51 |

FOREIGN PATENT DOCUMENTS

| | | |
|---|---|---|
| 0684613 A2 | 11/1995 | European Pat. Off. . |
| 0685772A1 | 12/1995 | European Pat. Off. . |
| 0708385 A2 | 4/1996 | European Pat. Off. . |
| A2-2-74975 | 3/1990 | Japan . |
| B2-5-84902 | 12/1993 | Japan . |
| 4-278978 | 10/1996 | Japan . |
| 2272581 | 5/1994 | United Kingdom . |

*Primary Examiner*—Joan Pendegrass

*Attorney, Agent, or Firm*—Birch, Stewart, Kolasch & Birch, LLP

[57] ABSTRACT

An image-forming device according to the present invention is provided with an image-carrying body, a transfer medium, which transfers the toner image formed on the image-carrying body to a transfer material, and an affixing body provided at the perimeter of the transfer medium, which electrically affixes and holds the transfer material to the transfer medium. The transfer medium is made up of at least a semiconducting layer and a conductive substrate supporting it. The semiconducting layer has a foam portion with foam particles which increase in diameter toward the conductive substrate. This foam portion is made of a dielectric sheet, which is manufactured by forming a foaming dielectric polymer into a sheet, and heating the two surfaces thereof at different temperatures. The foregoing structure can provide a desired elasticity with the portion with foam particles of large diameter, and a desired surface smoothness with the portion with foam particles of small diameter. Accordingly, the surface potential of the transfer drum can be maintained uniformly and stably, thus eliminating poor affixing of the transfer material to the transfer drum and poor transfer of the toner image to the transfer material.

23 Claims, 9 Drawing Sheets

IMAGE-FORMING DEVICE AND METHOD OF MANUFACTURING DIELECTRIC SHEET

FIELD OF THE INVENTION

The present invention relates to an image-forming device such as a laser printer, copy machine, laser fax, or a device combining several of these, and to a method of manufacturing a dielectric sheet to be used as the surface of a transfer medium of the image-forming device.

BACKGROUND OF THE INVENTION

In some conventional image-forming devices, an electrostatic latent image formed on a photoreceptive drum is developed and made visible by affixing toner thereto, and the toner image thus formed is transferred to a transfer material wrapped around a transfer drum.

In this type of image-forming device, as shown, for example, in FIG. 10, inside a drum 101 having a dielectric layer 101*a* are separately provided a corona electrical charger 102, for affixing a transfer sheet P to the drum 101, and a corona electrical charger 104, for transferring to the transfer sheet P a toner image formed on a photoreceptor drum 103. Thus affixing of the transfer sheet P and transfer of the toner image to the transfer sheet P are performed separately, by the corona electrical chargers 102 and 104, respectively.

Again, some image-forming devices, as shown in FIG. 11, are provided with a drum 201 with a two-layer structure of an outer semiconducting layer 201*a* and an inner base material 201*b*, and with a gripping structure 202, for maintaining a transfer sheet P in contact with the drum 201. In this image-forming device, the gripping structure 202 grasps one end of the transfer sheet P and brings it into contact with the surface of the drum 201. Then the surface of the drum 201 is given a charge by application of a voltage to the outer semiconducting layer 201*a* or by discharge of an electrical charger provided inside the drum 201. In this way, the toner image formed on the photoreceptor drum 103 is transferred to the transfer sheet P.

However, in the image-forming device shown in FIG. 10, the drum 101, which is a transfer roller, has a single-layer structure of the dielectric layer 101*a* only. Therefore, the corona electrical chargers 102 and 104 must be provided inside the drum 101. This places restrictions on the size of the drum 101, creating the problem that the size of the device as a whole cannot be reduced.

In the image-forming device shown in FIG. 11, the two-layer structure of the drum 201 is used to give the drum 201 the charge necessary to transfer the toner image to the transfer sheet P. Therefore, in this image-forming device, the number of chargers can be reduced. However, provision of the gripping structure 202 makes the structure of the image-forming device as a whole more complex. This leads to problems such as increase of the number of parts in the device as a whole and of the cost of manufacture.

In order to solve the foregoing problems, Unexamined Japanese Patent Publication No. 74975/1990 (Tokukaihei 2-74975), for example, discloses an image-forming device in which a corona electrical charger driven by a unipolar power source is provided near the point where a transfer material separates from a transfer drum made up of conductive rubber and a dielectric film layered on a grounded metal roll. In this image-forming device, a charge is induced in the conductive film by the corona electrical charger, thus affixing the transfer material to the transfer drum. After the transfer material is affixed to the transfer drum, a further charge is induced, causing transfer to occur.

Accordingly, in the above image-forming device, the affixing of the transfer material and the transfer of the toner image carried out by charging the surface of the transfer drum can both be carried out by a single charger. As a result, the transfer drum can be reduced in size. Further, there is no need for a structure like the gripping structure 202 to hold the transfer material, and the transfer material can be affixed by means of a simple structure.

Further, U.S. Pat. No. 5,390,012 discloses a transfer device provided with a transfer drum having at least an elastic layer made of a foam material and a dielectric layer covering the elastic layer, in which single-color toner images successively formed on a photoreceptor drum are successively transferred to a transfer material affixed to the transfer drum, thus forming a full-color image on the transfer material.

In this transfer device, the transfer material is electrostatically affixed to the transfer drum using an affixing roller as charge applying means. Further, by providing a gap of 10 $\mu$m or more between the elastic layer and the dielectric layer, a charge is allowed to build up on the reverse side of the dielectric layer (the side away from the transfer material). As a result, the potential of the dielectric layer can be maintained without being influenced by the environment, thus improving the affixing of the transfer material to the transfer drum. Also disclosed is a method of creating an electric field necessary to affix the transfer material to the surface of the transfer drum by scattering insulator particles in the gap between the elastic layer and the dielectric layer.

Although it is not disclosed in the foregoing, a method providing an intermediate resistor between the dielectric layer and the elastic layer is also possible. In this case, the change of the electric field due to the gap between the elastic layer and the dielectric layer will be as small as possible.

Further, Japanese Examined Patent Publication No. 84902/1993 (Tokukohei 5-84902) discloses a multi-layered transfer device having a transfer drum for transferring a toner image formed on a photoreceptor drum to a transfer material at a transfer point. On the transfer drum is layered a dielectric layer with a dielectric constant of 3.0 to 13.0, a thickness of 70 $\mu$m to 200 $\mu$m, and a critical surface tension of no more than 40 dyne/cm. In this multi-layered transfer device, transfer performance in an environment or ambient atmosphere is maintained by the electrical characteristics of the dielectric layer described above. Further, cleaning of the transfer drum after separation of the transfer material is ensured by the critical surface tension mentioned above.

Further, a transfer drum with the structure shown in FIG. 12, in which a semiconducting layer 302 and a dielectric layer 303 are layered, in that order, on the surface of a conductive layer 301 made of aluminum, etc., has also been proposed. In a transfer drum of this type, the semiconducting layer 302 is made of a foam material which is a mixture of, for example, EPDM (ethylene-propylene-diene co-polymer) and conductive particles, a foaming agent, etc. As a result, a plurality of tiny bubbles are formed within the semiconducting layer 302, and these bubbles give the surface of the transfer drum a cushion. Further, when a voltage is applied to the conductive layer 301, giving it a potential difference from a ground roller (not shown), a discharge effect arises in these bubbles. This discharge causes a charge to arise on the reverse side of the dielectric layer 303 (the side toward the semiconducting layer 302), which gives rise to a strong affixing force with respect to the transfer material.

With the structure according to Unexamined Japanese Patent Publication No. 74975/1990 (Tokukaihei 2-74975), charging of the surface of the transfer drum is performed by atmospheric discharge from the corona electrical charger. As a result, when transfer is to be carried out a number of times, as for instance in color copying, the charge must be replenished by the corona electrical charger after each transfer. Accordingly, a charging unit composed of a unipolar power source, etc. becomes necessary to control driving of the corona electrical charger. This gives rise to problems such as increase of the number of parts in the device and of the cost of manufacture.

Further, since the surface of the transfer drum is charged by atmospheric discharge, any scratch or nick in the surface of the transfer drum will reduce the electric field area. As a result, the electric field balance will be disturbed at the scratch or nick, giving rise to transfer failure such as a white spot at that point, and to diminished image quality. Further, with atmospheric discharge, the voltage required to charge the surface of the transfer drum is large, and the energy necessary to drive the image-forming device is increased. Atmospheric discharge is also easily influenced by environmental factors such as air temperature and humidity, and changes in the environment can give rise to uneven potential in the surface of the transfer drum. This can result in problems such as insufficient affixing of the transfer material, distortion of printed letters, etc.

Again, in the structure according to U.S. Pat. No. 5,390,012, a gap is provided between the elastic and dielectric layers making up the transfer drum. As transfer is performed repeatedly, the form of the dielectric layer is repeatedly changed each time a nip is formed between the dielectric layer and the photoreceptor, and the gap becomes larger over time. In other words, uniformity cannot be maintained in the size of the gap (which is distinct from the dielectric layer) formed between the foam elastic layer and the dielectric layer. Nor does the resistance of the elastic layer remain constant over time. As a result, image quality deteriorates as transfer is performed repeatedly. In order to maintain uniformity of the size of the gap and the resistance of the dielectric layer, the structure of the transfer device becomes complicated, giving rise to the problem of increase of the manufacturing cost of the device as a whole.

Further, the disclosure cited above does not stipulate the hardness of the elastic layer or the contact pressure between the charge-applying means (affixing roller) and the transfer drum. Nor does it discuss the width of the nip between the charge-applying means (affixing roller and bias voltage applying method) and the transfer drum, or the nip time. In other words, the nip time is apparently fixed, regardless of the type of transfer material.

It is well known that the amount of charge injected into a transfer material during a constant nip time generally varies according to the transfer material used. A transfer drum's ability to electrostatically affix a transfer material to the dielectric layer is also dependent on the transfer drum's hardness, i.e., the amount of elastic change in its form. Accordingly, with the structure according to the disclosure cited above, the ability of the transfer drum to perform transfer by electrostatic charge may be impaired, depending on the type of transfer material used. This results in the problem of poor transfer of the toner image from the photoreceptor drum to the transfer material. Further, with this method, at least two power sources are required: an affixing roller power source for affixing the transfer material to the transfer drum, and a power source for applying to the transfer material at the time of toner transfer a voltage of reverse polarity with respect to the toner. This results in the problem of increase of the number of parts and the size of the device as a whole.

Further, since a foam material is used to provide the gap, there are cases, depending on the quantity of toner at the time of transfer, when the pattern of the foam shows in the printed letters. As a method of resolving this problem caused by the gap, the LBP2030 image-forming device manufactured by Canon Co., Ltd., for example, provides an intermediate resistance coating on the reverse side of the dielectric sheet used as the surface layer of the transfer drum. By this means, the local differences in electric field which arise due to the gap of the elastic layer are brought into uniformity.

However, with this type of full-color printer, which is already on the market, it is difficult to stably hold the transfer material by electrical attraction alone, and a transfer material gripper, etc. becomes necessary to hold the transfer material. This results in the problem of increase of the number of parts and of the size of the device as a whole.

Again, in the transfer drum structure shown in FIG. 12, the air bubbles within the semiconducting layer 302 are provided with a substantially uniform size. As a result, image quality deteriorates in both high-temperature, high-humidity and low-temperature, low-humidity operating environments.

In order to satisfy both solid/halftone transfer and letter transfer, it is necessary to increase the hardness of the transfer drum by uniformly reducing the diameter of the foam particles. However, if the diameter of the foam particles is uniformly reduced, a phenomenon occurs under high-temperature, high-humidity conditions in which some of the lines making up printed letters are not printed, thus impairing image quality, and affixing of the transfer material using electric lines of force is also diminished.

If, on the other hand, the hardness of the transfer drum is reduced by uniformly increasing the size of the foam particles, white spots, scattering, etc. occur in the printed image under low-temperature, low-humidity conditions due to the bubbles within the foam area, which markedly diminish image quality.

It has been experimentally found that with foam particles approximately 1 mm in diameter, white spots are clearly visible even in solid transfer, and that with foam particles 500 $\mu$m or more in diameter, white spots occur in halftone transfer.

Accordingly, with regard to image-forming devices in which a toner image is transferred from a photoreceptor to a transfer material while the transfer material is electrostatically affixed and held to the surface of a transfer drum, various operating conditions such as high-temperature, high-humidity and low-temperature, low-humidity conditions need to be taken into consideration. However, in the transfer drum structure discussed above, since the foam particles in the semiconducting layer 302 are provided with a substantially uniform size, image quality is diminished in both high-temperature, high-humidity and low-temperature, low-humidity conditions. As a result, this image-forming device has the shortcoming that insufficient affixing of the transfer material, distortion of printed letters, deterioration of image quality, etc. are likely to occur.

In order to avoid white spots, etc., a conductive film (approx. 8 Ω/cm to 9 Ω/cm) could be provided between the semiconducting layer 302 and the dielectric layer 303 of the transfer drum. However, in this case the affixing of the transfer material is markedly impaired, making a transfer material gripper necessary to hold the transfer material, and thus increasing the size of the device as a whole.

SUMMARY OF THE INVENTION

The present invention is intended to resolve the problems discussed above, and its object is to provide an image-forming device able to improve transfer performance, without causing structural complexity, by maintaining a uniform and stable surface potential in a transfer medium such as a transfer drum, thereby eliminating poor affixing of a transfer material to the transfer medium and poor transfer of a toner image to the transfer material, and to provide a method of manufacturing a dielectric sheet to be used as the surface of the transfer medium of the image-forming device.

In order to attain the above-mentioned object, an image-forming device according to the present invention is provided with:

an image-carrying body, on which a toner image is formed;

a transfer medium, which transfers the toner image formed on the image-supporting body to a transfer material by bringing the transfer material into contact with the transfer medium; and an affixing body provided at the perimeter of the transfer medium, which electrically affixes and holds the transfer material to the transfer medium;

with the transfer medium being made up of at least a semiconducting layer and a conductive substrate supporting it;

and the semiconducting layer having a foam portion with foam particles which increase in diameter toward the conductive substrate.

With the foregoing structure, the transfer material is electrically affixed and held to the transfer medium by the affixing body. Then, when the transfer material is brought into contact with the image-carrying body by the rotation of the transfer medium, a potential difference between the image-carrying body and the transfer medium causes the toner image formed on the image-carrying body to be transferred to the transfer material.

The semiconducting layer of the transfer medium has a foam portion with foam particles which increase in diameter toward the conductive substrate. By this means, the inner portion thereof (the portion toward the conductive substrate) with large foam particles can provide a desired elasticity, and the outer portion thereof (the portion which touches the transfer material) with small foam particles can provide a desired smoothness.

Accordingly, the foregoing structure can provide both elasticity and surface smoothness of the transfer medium. Therefore, the transfer material can be held stably in both high-temperature, high-humidity and in low-temperature, low-humidity operating conditions, and good attraction of the transfer material for the transfer medium can be maintained. As a result, transfer performance is improved, and thus poor transfer of the toner image, distortion of printed letters, deterioration of image quality, etc. can be avoided with certainty. Since the transfer material can be held stably, a stable device not prone to breakdown can be provided. Further, since the image-forming device can be realized by a simple structure like that outlined above, the size of the device can also be reduced.

The foregoing structure of the transfer medium can also be applied to an intermediate transfer medium of an image-forming device provided with an image-carrying body, on which a toner image is formed; an intermediate transfer medium, to which the toner image formed on the image-carrying body is temporarily transferred; and a transfer means, which electrostatically transfers to a transfer material the toner image temporarily transferred to the intermediate transfer medium.

The foregoing structure can provide both elasticity and surface smoothness of the intermediate transfer medium. Therefore, the transfer material can be stably held in both high-temperature, high-humidity and in low-temperature, low-humidity operating conditions, and good affixing of the transfer material to the transfer medium can be maintained. As a result, since transfer performance is improved, poor transfer of the toner image, distortion of printed characters, deterioration of image quality, etc. can be avoided with certainty, and other effects like those of the first image-forming device with transfer medium above can also be obtained.

In order to attain the object mentioned above, a method of manufacturing a dielectric sheet according to the present invention is a method of manufacturing a dielectric sheet to be used as the surface of a transfer medium, which brings a transfer material electrically affixed and held to the surface of the transfer medium into contact with an image-carrying body, thus transferring to the transfer material a toner image formed on the image-carrying body, and includes the steps of:

(a) heating a dielectric polymer containing a foaming group or a foaming agent so as to form a sheet; and (b) heating each side of the formed sheet at a different temperature, so as to foam the dielectric polymer.

With the foregoing method, when the formed sheet of dielectric polymer is heated, it is foamed by the foaming group or foaming agent contained therein. Then, a dielectric sheet made of this kind of foam material can be attached around the outside of, for example, a plain cylinder of aluminum using a conductive adhesive, thus providing a transfer medium.

Since, when heating the formed sheet, each side thereof is heated at a different temperature, in the side heated to a higher temperature, foaming is more promoted than in the side heated to a lower temperature. As a result, a dielectric sheet is formed which has a foam area in which the diameter of the foam particles becomes gradually larger toward one side. By this means, the side with foam particles larger in diameter can provide a desired elasticity. The side with foam particles smaller in diameter, on the other hand, can provide a desired smoothness.

Accordingly, with the foregoing method, elasticity and smoothness of the transfer medium can both be obtained at the time of forming the transfer medium. Therefore, the transfer material can be stably held regardless of high-temperature, high-humidity or low-temperature, low-humidity operating conditions, and good attraction of the transfer material for the transfer medium can be maintained. As a result, transfer performance is improved, and poor transfer of the toner image, distortion of printed characters, deterioration of image quality, etc. can be avoided with certainty. Further, since the transfer material can be held stably, a stable device not prone to breakdown can be provided. In addition, since the dielectric sheet can be manufactured by means of the comparatively simple method described above, the cost of manufacturing the dielectric sheet, and the price of the device as a whole, can be reduced.

In order to attain the object mentioned above, another method of manufacturing a dielectric sheet according to the present invention is a method of manufacturing a dielectric sheet to be used as the surface of a transfer medium, which brings a transfer material electrically affixed and held to the surface of the transfer medium into contact with an image-carrying body, thus transferring to the transfer material a toner image formed on the image-carrying body, and includes the steps of:

(a) extruding a dielectric polymer containing a foaming group or a foaming agent in the form of a cylinder; and (b) heating an inner surface of the cylinder, so as to foam the dielectric polymer.

With the foregoing method, when the dielectric polymer which has been injected into a cylindrical mold is heated, the dielectric polymer is foamed by the foaming group or foaming agent contained therein. Then, by attaching, for example, a plain cylinder of aluminum to the inner side of a cylindrical dielectric sheet made of this kind of foam material, a transfer medium can be provided.

Since the dielectric sheet is foamed by heating the inner side of the cylindrical mold, foaming is more promoted toward the interior of the mold than toward the exterior thereof. As a result, a dielectric sheet is formed which has a foam area in which the diameter of the foam particles becomes gradually smaller toward the exterior of the mold. By this means, the side with foam particles larger in diameter can provide a desired elasticity. The side with foam particles smaller in diameter, on the other hand, can provide a desired surface smoothness.

Accordingly, with the foregoing method, elasticity and smoothness of the transfer medium can both be obtained at the time of forming the transfer medium. Therefore, the transfer material can be stably held regardless of high-temperature, high-humidity or low-temperature, low-humidity operating conditions, and good attraction of the transfer material for the transfer medium can be maintained. As a result, transfer performance is improved, and thus poor transfer of the toner image, distortion of printed characters, deterioration of image quality, etc. can be avoided with certainty. Further, since the transfer material can be held stably, a stable device not prone to breakdown can be provided.

In addition, with the foregoing method, the cylindrical dielectric sheet can be provided with portions with foam particles of different diameter by merely heating the inner side of the cylindrical mold. Thus a desired dielectric sheet can be obtained comparatively simply.

Additional objects, features, and strengths of the present invention will be made clear by the description below. Further, the advantages of the present invention will be evident from the following explanation in reference to the drawings.

DESCRIPTION OF THE EMBODIMENTS

The following will explain an embodiment of the present invention with reference to FIGS. 1 through 9.

Figure 2:
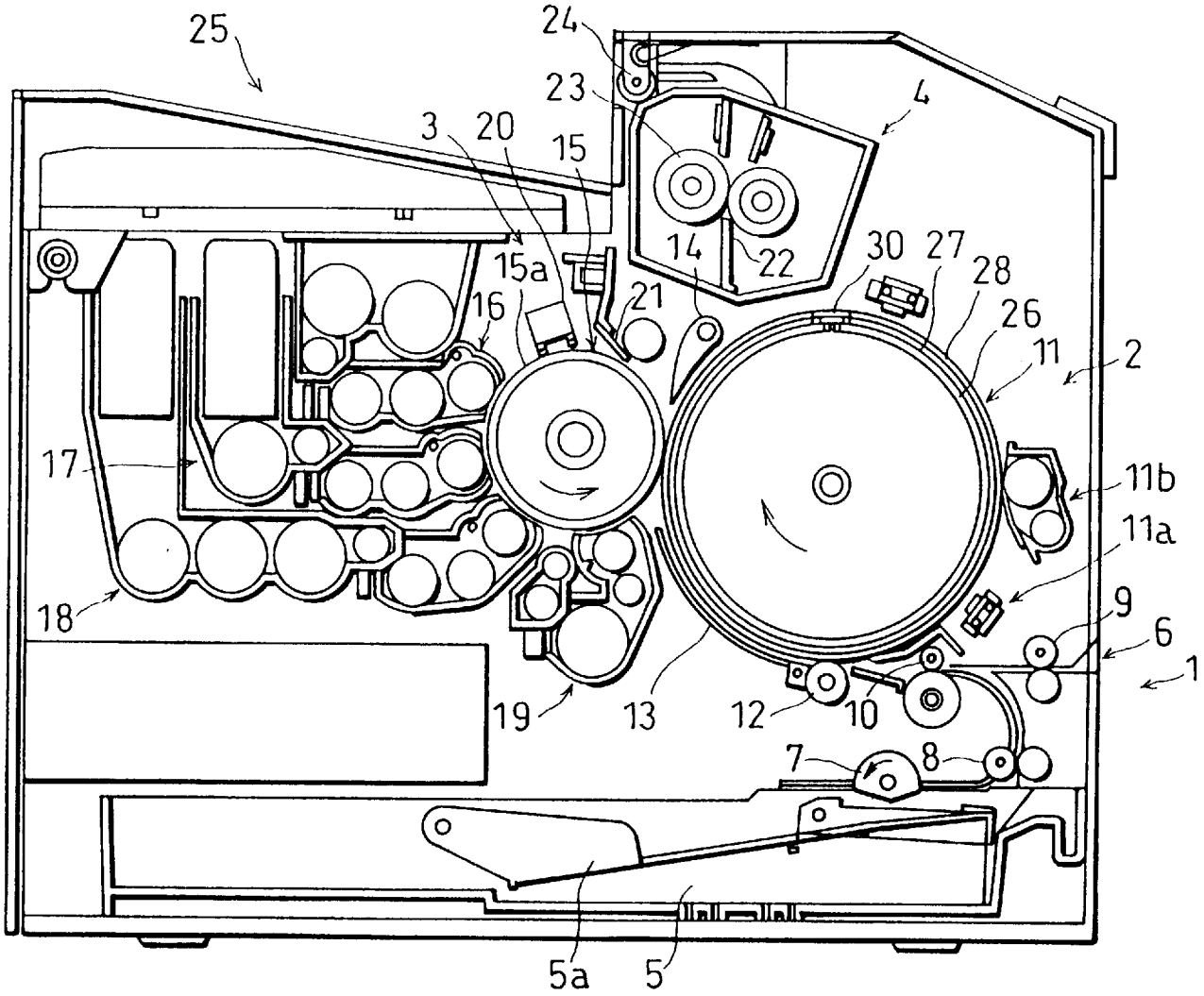
FIG. 2 is a cross-sectional view schematically showing the structure of an image-forming device according to the present invention.

As shown in FIG. 2, an image-forming device according to the present embodiment is made up of a paper supply section 1, which stores and supplies to a transfer section 2 sheets of transfer paper P (see FIG. 3) serving as transfer material on which images are formed in toner; a transfer section 2, in which toner images are transferred to the transfer paper P; a developing section 3, in which toner images are formed; and a fixing section 4, in which toner images transferred to the transfer paper P are fused onto and fixed to the transfer paper P.

The paper supply section 1 is provided with a paper supply cassette 5, which stores the transfer paper P and supplies it to the transfer section 2, and which is provided in the lowest part of the main body of the device such that it may be freely inserted and detached; a hand-feed section 6, provided in the front of the main body such that the transfer paper P may be supplied by hand feed one sheet at a time; a pickup roller 7, which delivers one sheet at a time from the top of a stack of transfer paper P in the paper supply cassette 5; pre-feed rollers 8 (hereinafter referred to as "PF rollers 8"), which transport sheets of transfer paper P delivered by the paper supply cassette 5; hand-feed rollers 9, which transport sheets of transfer paper P from the hand-feed section 6 to the transfer section 2; and pre-curl rollers 10, which curl sheets of transfer paper P transported from the PF rollers 8 or the hand-feed rollers 9.

The paper supply cassette 5 is provided with a delivery member 5*a*, which is pushed upward by a spring, etc., and on which the transfer paper P is stacked. By this means, the transfer paper P in the paper supply cassette 5 is brought into contact with the pickup roller 7, which, in accordance with rotation in the direction of the arrow, delivers the transfer paper P one sheet at a time to the PF rollers 8, which transport it to the pre-curl rollers 10.

Sheets of transfer paper P supplied from the hand-feed section 6 are transported by the hand-feed rollers 9 to the pre-curl rollers 10. As mentioned above, the pre-curl rollers 10 curl the transfer paper P, to make it easier for the transfer paper P to be affixed to the surface of a cylindrical transfer drum 11 provided in the transfer section 2.

Further, the paper supply section 1 is also provided with a transfer paper sensor 33 (see FIG. 3), which senses the type of the transfer paper P. The transfer paper sensor 33 is connected to control means (not shown), and, by means of the control exerted thereby, measures the material of the transfer paper P as it is transported to the transfer drum 11 prior to its electrostatic affixing to the transfer drum 11, thus sensing the type of the transfer paper P.

In the transfer section 2 is provided a transfer drum 11 (transfer medium), which brings the transfer paper P into contact with a photoreceptive drum 15 to be discussed below, and which transfers a toner image formed on the photoreceptor drum 15 to the transfer paper P. Around the transfer drum 11 are provided a ground roller 12 (affixing body), which is grounded, and which is an attaching means used to electrically affix and hold the transfer paper P to the transfer drum 11; a guide member 13, which guides the transfer paper P so that it will not fall off the transfer drum 11; a separation tongue 14, which separates from the transfer drum 11 by force the transfer paper P affixed thereto, etc. The details of the structure of the transfer drum 11 will be discussed below. The separation tongue 14 is provided so as to be able to freely touch or move away from the surface of the transfer drum 11.

Also provided at the perimeter of the transfer drum 11 is a cleaning device 11*b*, which removes any toner remaining on the transfer drum 11 after a sheet of transfer paper P has been separated therefrom. By this means, the transfer drum 11 is cleaned before affixing of the next sheet of transfer paper P. This enables stable affixing, and prevents dirtying of the back of the next sheet of transfer paper P.

Also provided at the perimeter of the transfer drum 11 is a charge eliminator 11*a*, which, after removal of remaining toner by the cleaning device 11*b*, removes any remaining charge which may have been given to the transfer drum 11 at the time of separation of the transfer paper P, etc. The charge eliminator 11*a* is provided upstream (with respect to the direction in which a sheet of transport paper P is transported) from the ground roller 12. By this means, no charge will remain on the transfer drum 11, and the next sheet of transfer paper P can be stably affixed. In addition, the potential of the transfer drum 11 after separation of the transfer paper P can be set to a standard level, thus stabilizing the transfer electric field for the next transfer.

In the developing section 3 is provided a photoreceptive drum 15 (image-carrying body), which presses against the transfer drum 11. The photoreceptive drum 15 is made of a grounded, conductive aluminum cylinder 15*a*, to the surface of which is applied an OPC (Organic Photoconductive Conductor) film 15*b* (see FIGS. 5 and 6). Instead of OPC, selenium (Se), for example, may be used.

Around the photoreceptor drum 15, developers 16, 17, 18, and 19, which store yellow, magenta, cyan, and black toner, respectively, are provided in a radial arrangement. A charger 20, which charges the surface of the photoreceptive drum 15, and a cleaning blade 21, which scrapes remaining toner from the surface of the transfer drum 15, are also provided. A toner image is formed on the photoreceptive drum 15 for each of the respective toners. In other words, with respect to the photoreceptive drum 15, charging, exposure, developing, and transfer are repeated for each color.

Accordingly, in full-color transfer, for each rotation of the transfer drum 11, a toner image of a single color formed on the photoreceptive drum 15 is transferred to the transfer paper P electrostatically affixed to the transfer drum 11, and a full-color image can be obtained by a maximum of four rotations of the transfer drum 11.

In consideration of transfer efficiency and image quality, the photoreceptive drum 15 and the transfer drum 11 press against each other at the transfer point X (see FIG. 3) with a force of 8 Kg per unit area.

In the fixing section 4 are provided fixing rollers 23 which fuse and fix the toner image onto the transfer paper P by applying a predetermined temperature and pressure, and a fixing guide 22, which guides to the fixing rollers 23 the transfer paper P which has been separated from the transfer drum 11 by the separation tongue 14 after transfer of the toner image. Further, in the downstream transport direction in the fixing section 4 is provided a discharge roller 24, which discharges a sheet of transfer paper P which has undergone fixing from the main body of the device into a discharge tray 25.

Next, the image formation process in an image-forming device with the foregoing structure will be explained with reference to FIG. 2.

As shown in FIG. 2, first, in the case of automatic paper supply, one sheet at a time from the top of the stack of transfer paper P in the paper supply cassette 5 (which is provided in the lowest part of the main body of the device) is delivered by the pickup roller 7 to the PF rollers 8. A sheet of transfer paper P which has passed through the PF rollers 8 is curled by the pre-curl rollers 10 to conform to the shape of the transfer drum 11.

In manual paper supply, on the other hand, the transfer paper P is supplied one sheet at a time from the hand-feed section 6 provided in the front of the main body of the device, and is transported by the hand-feed rollers 9 to the pre-curl rollers 10. Then the sheet of transfer paper P is curled by the pre-curl rollers 10 to conform to the shape of the transfer drum 11.

Next, the sheet of transfer paper P curled by the pre-curl rollers 10 is transported between the transfer drum 11 and the ground roller 12. At this time, a charge is induced in the surface of the sheet of transfer paper P by a charge induced in the surface of the transfer drum 11. By this means, the transfer paper P is electrostatically affixed to the surface of the transfer drum 11.

The sheet of transfer paper P affixed to the transfer drum 11 is then transported to the transfer point X, which is the place where the transfer drum 11 and the photoreceptive drum 15 press against one another, and the toner image formed on the photoreceptive drum 15 is transferred to the transfer paper P due to a potential difference between the charge of the toner and the charge of the surface of the transfer paper P.

At this time, with respect to the photoreceptive drum 15, charging, exposure, developing, and transfer are repeated for each color. Accordingly, the transfer paper P turns with the transfer drum 11 while remaining affixed thereto, and transfer of a single color is performed for each rotation, and a full-color image can be obtained by a maximum of four rotations of the transfer drum 11. However, for a black and white or single-color image, a single rotation of the transfer drum 11 is sufficient.

Then, after the toner images of each color have been transferred to the transfer paper P, it is separated by force from the surface of the transfer drum 11 by the separation tongue 14 (provided above the transfer drum 11 so as to be able to touch or move away from it) and guided toward the fixing guide 22.

Next, the toner image on the transfer paper P which has been guided to the fixing rollers 23 by the fixing guide 22 is fused onto and fixed to the transfer paper P by the heat and pressure of the fixing rollers 23. The transfer paper P which has undergone fixing is then discharged by the discharge roller 24 into the discharge tray 25.

Figure 3:
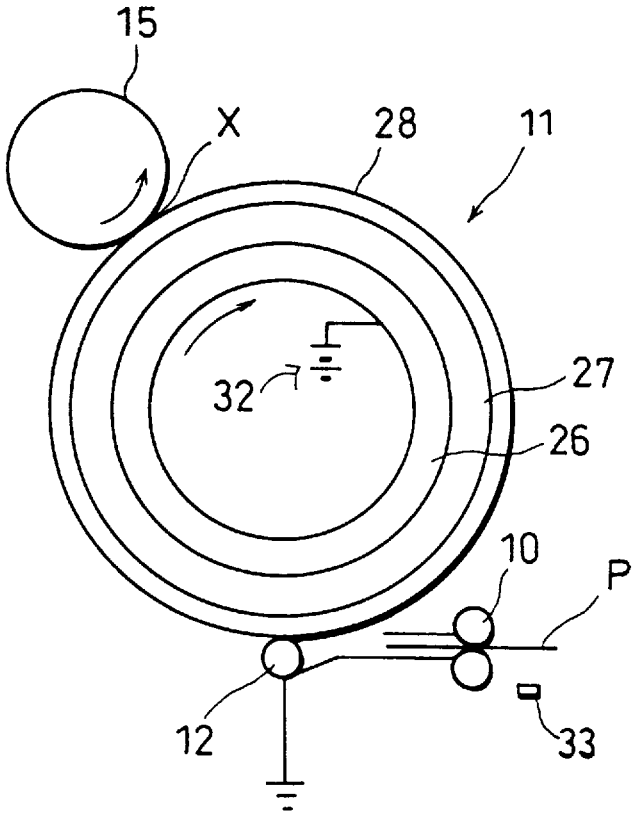
FIG. 3 is a cross-sectional view showing the structure of a transfer drum provided in the above-mentioned image-forming device.

Next, the details of the structure of the transfer drum 11 will be explained with reference to FIG. 1 and FIGS. 3 through 6. As shown in FIG. 3, the transfer drum 11 has as its base material a conductive layer 26 (conductive substrate) made of an aluminum cylinder, on the outer surface of which are layered a semiconducting layer 27 and a dielectric layer 28, in that order. A power source 32 is connected to the conductive layer 26, and applies a voltage thereto, thus maintaining a stable voltage throughout the entirety of the conductive layer 26.

Here, an aluminum cylinder is used for the conductive layer 26, but a different conductor may also be used. Again, the dielectric layer 28 may be provided as needed. In other words, the transfer drum 11 may also be a transfer medium having a structure in which only the semiconducting layer 27 is provided on the conductive layer 26.

The semiconducting layer 27 is a foam material in which 5 to 95 parts by weight of conductive particles of at least one of carbon, carbon black, $TiO_2$ (titanium oxide), etc. are mixed with 100 parts by weight of a dielectric polymer such as EPDM (ethylene-propylene-diene co-polymer), and which is foamed by heating due to the action of a foaming group or foaming agent. Then, a semiconducting layer 27 of the desired dimensions can be obtained by blending an appropriate resistive material such as zinc oxide, zinc stearate, paraffin oil, etc. with the foam material, vulcanizing it, and then polishing the surface with sandpaper or a grindstone. The conductive layer 26 and the semiconducting layer 27 are joined together with a conductive adhesive, for example, one in which carbon is dispersed. Alternatively, the conductive layer 26 and the semiconducting layer 27 may be formed integrally by injection molding.

In addition to the example given above, the dielectric polymer may be, for example, a polyurethane such as soft polyurethane foam or polyurethane elastomer, urethane, nylon, silicone, PET (polyethylene terephthalate), PTFE (polytetrafluoroethylene), PVDF (polyvinylidene fluoride), natural rubber, nitryl-butadiene rubber, chloroprene rubber, styrene-butadiene rubber, butadiene rubber, ethylene-propylene rubber, isopropylene rubber, polynorbornene rubber, etc.

Since all of the materials mentioned above are comparatively inexpensive, forming the semiconducting layer 27 of these materials can reduce the manufacturing costs of the device, and a device can be provided which is less expensive and more stable than conventional devices.

Further, a foam material can also be formed by mixing conductive particles with nylon 6 or nylon 66, a co-polymer of PTFE and urethane, PET, etc.

The foaming group is formed by a chemical reaction using one or more of, for example, propylene oxide, ethylene oxide, polyether-polyol, tolylenediisocyanate, 1-1 butanediol, a silicon-based surfactant, di-n-butyltindilaurate, etc. By forming the foaming group using these typical, stable materials, a stable device can be provided.

If a foaming agent is to be used, the interior of the semiconducting layer 27 can be foamed easily and the semiconducting layer 27 provided by a simple manufacturing process if a nitrogen-based foaming agent is used. In this case, it is preferable to mix in a suitable amount of a silicon-based surfactant such as polydialkyl siloxane, a polysiloxane-polyalkylene oxide block co-polymer, etc.

Dispersing conductive particles in the semiconducting layer 27 makes it easy to electrically adjust the resistance of the semiconducting layer 27. Accordingly, with the foregoing structure, uneven resistance within the semiconducting layer 27 can be reduced easily. In particular, this effect can be obtained with certainty if the conductive particles are at least one of carbon, carbon black, and $TiO_2$.

In addition to carbon, carbon black, and $TiO_2$, the conductive particles may also be sodium perchlorate or another typical ionic conductive material. In this case, the semiconducting layer 27 may be formed more uniformly than if an ionic conductive material is not used.

In particular, a uniform semiconducting layer 27 can be formed with certainty if the ionic conductive material used is one of sodium perchlorate, calcium perchlorate, sodium chloride, denatured fat dimethylethyl ammonium ethosulfate, stearyl ammonium acetate, lauryl ammonium acetate, and octadecyltrimethyl ammonium perchlorate.

Figure 1:
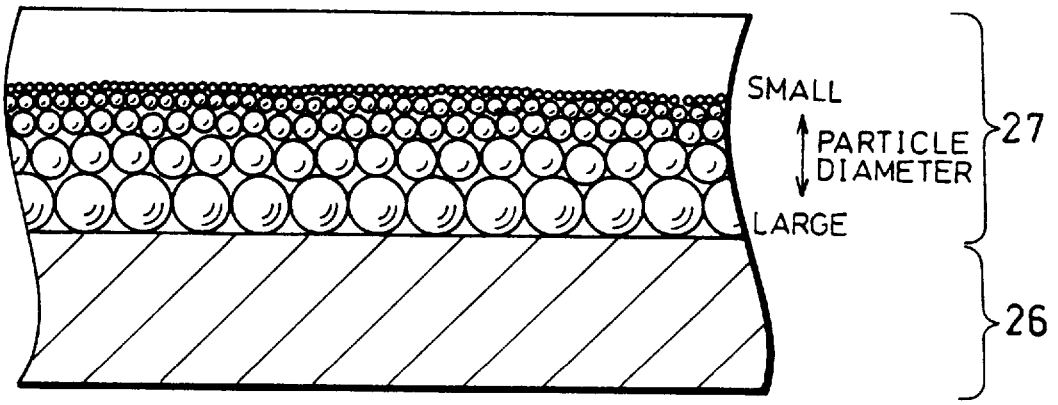
FIG. 1 is a cross-sectional view schematically showing the structure of a dielectric sheet according to one embodiment of the present invention.

As shown in FIG. 1, the semiconducting layer 27 has a foam portion with foam particles which increase in diameter toward the conductive layer 26.

Here, an experiment was performed in which performance with regard to white spots under low-temperature, low-humidity conditions, non-printing of characters, and affixing of the transfer material was judged for foam particles of various diameters. The results of this experiment are shown in Table 1.

TABLE 1

| FOAM PARTICLE DIAMETER (μm) | 0 | 100 | 250 | 500 | 750 | 1000 |
|---|---|---|---|---|---|---|
| WHITE SPOTS UNDER LOW-TEMPERATURE, LOW-HUMIDITY CONDITIONS | ○ | ○ | ○ | ○ | X | X |
| NON-PRINTING OF CHARACTERS | X | ○ | ○ | ○ | ○ | X |
| AFFIXING OF TRANSFER MATERIAL | X | Δ~○ | ○ | ○ | ○ | ○ |

○: Good
Δ: Fair
X: Poor

As the results in Table 1 show, if the foam particles are more than 500 μm in diameter, affixing of the transfer material is good, but white spots occur under low-temperature, low-humidity conditions. Further, with foam particles more than 750 μm in diameter, non-printing of characters occurs due to large fluctuations in the electric field in the vicinity of the foam particles.

On the other hand, if the foam particles are less than 100 μm, non-printing of characters occurs due to local increases in the contact pressure with the photoreceptive drum 15, and affixing of the transfer material is also impaired.

Accordingly, as the foregoing results show, it is preferable if the diameters of the foam particles in the foam portion are from 100 μm to 500 μm. In this case, good transfer performance of the transfer material can be maintained without giving rise to non-printing of images or letters under low-temperature, low-humidity conditions. In the present embodiment, a foam portion is provided which has foam particles with diameters within this range.

Next, an experiment was performed in which performance with regard to non-transfer in halftone printing due to breakdown, uneven transfer, and affixing of the transfer material was judged for various thicknesses of the semiconducting layer 27. The results of this experiment are shown in Table 2.

TABLE 2

| THICKNESS (μm) | 100 | 200 | 300 | 1000 | 3000 | 6000 | 8000 |
|---|---|---|---|---|---|---|---|
| NON-TRANSFER IN HALFTONE PRINTING DUE TO BREAKDOWN | X | X | ○ | ○ | ○ | ○ | X |
| UNEVEN TRANSFER | X | X | ○ | ○ | ○ | ○ | X |
| AFFIXING OF TRANSFER MATERIAL | X | Δ | ○ | ○ | ○ | ○ | X |

○: Good
Δ: Fair
X: Poor

As shown by the results in Table 2, if the semiconducting layer 27 is more than 600 μm thick, affixing of the transfer material is impaired, and uneven transfer and uneven resistance occur, because of worsening of deviation and surface precision at the time of manufacturing of the transfer drum 11.

On the other hand, if the semiconducting layer 27 is less than 300 μm thick, breakdown can occur under high-temperature, high-humidity conditions, causing non-transfer.

Accordingly, as the foregoing results show, it is preferable if the semiconducting layer 27 is from 300 μm to 600 μm thick. In this case, good affixing of the transfer material can be maintained without giving rise to non-transfer or uneven transfer. Further, the transfer electric field at the time of transfer of the toner image to the transfer material can be adjusted comparatively easily, and greater freedom in setting the transfer electric field can be obtained.

In the present embodiment, the semiconducting layer 27 is 300 μm thick. It has been experimentally shown that in this case the transfer electric field at the time of transfer to the transfer paper P can be adjusted comparatively easily. Accordingly, in this case, sufficient freedom in setting the transfer electric field can be obtained.

Next, an experiment was performed in which performance with regard to scattering of image and affixing of the transfer material was judged for various dielectric constants of the semiconducting layer 27. The results of this experiment are shown in Table 3.

TABLE 3

| DIELECTRIC CONSTANT | 2 | 5 | 10 | 13 | 22 |
|---|---|---|---|---|---|
| SCATTERING OF IMAGE | X | X | ○ | ○ | ○ |
| AFFIXING OF TRANSFER MATERIAL | X | X | ○ | ○ | ○ |

○: Good
Δ: Fair
X: Poor

As the results in Table 3 show, if the dielectric constant is less than 10, the decay of potential is faster, and affixing and holding of the transfer material cannot be maintained, especially in multiple transfer. Further, since initial attachment at the time of supply of the transfer material is by means of a discharge, unless the electrostatic capacitance is fairly large, scattering of the image occurs at the time of transfer from the photoreceptive drum 15.

Accordingly, as shown by the foregoing results, it is preferable if the semiconducting layer 27 has a dielectric constant of 10 or more. In this case, decay of potential at a predetermined rate can be obtained, and the surface potential of the transfer medium or the intermediate transfer medium can be stably maintained for a sufficient duration. As a result, good affixing and holding of the transfer material, especially in multiple transfer, can be obtained, and scattering of the image can be held to a minimum. In the present embodiment, the semiconducting layer 27 has a dielectric constant of 12.

The materials used for the semiconducting layers 27 in each of the experiments above had the same conductivity, and a constant weight ratio of conductive particles.

The dielectric layer 28 is made of, for example, PVDF. When the transfer drum 11 has a three-layer structure like that shown in FIG. 3, the dielectric layer 28 may be manufactured by extruding the PVDF or other material to a thickness of 50 μm to 150 μm and placing it in a mold of predetermined form, which is then baked. It is sufficient if the dielectric layer 28 and the semiconducting layer 27 are bonded and fixed to each other at least in places.

Figure 4:
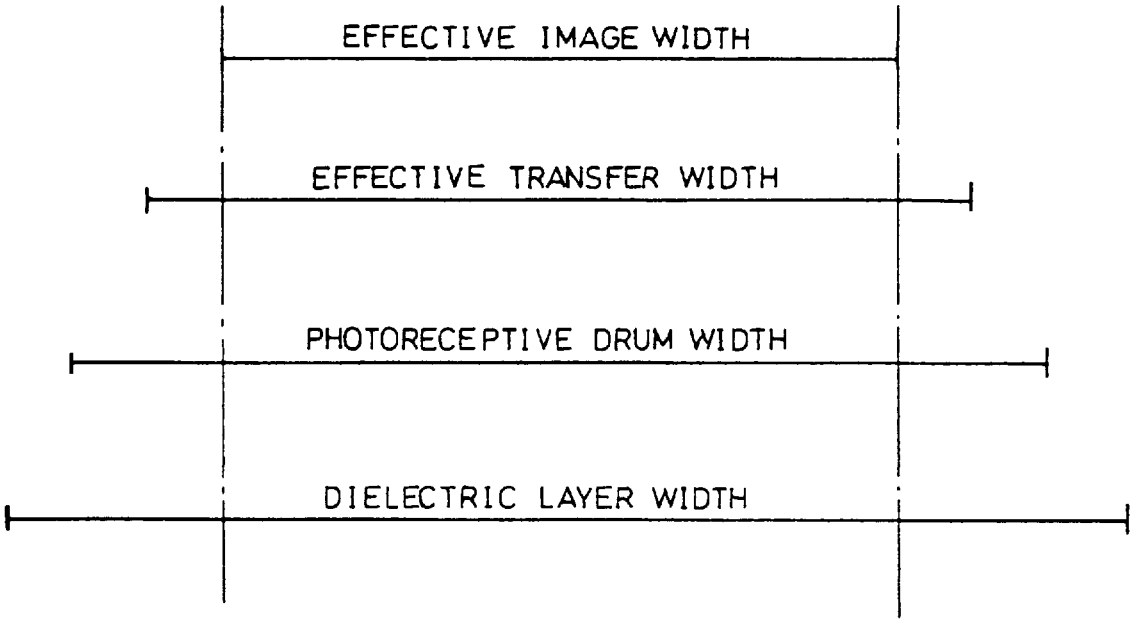
FIG. 4 is an explanatory diagram showing a comparison of the width of a dielectric layer of the above-mentioned transfer drum, the width of a photoreceptive drum, an effective transfer width, and an effective image width.

As shown in FIG. 4, the dielectric layer 28 is wider than the photoreceptor cylinder (the aluminum cylinder 15*a*) which forms the photoreceptive drum 15, and the photoreceptor cylinder is wider than an effective transfer width, which is in turn wider than an effective image width (the width of the coating of the OPC film 15*b*).

Figure 5:
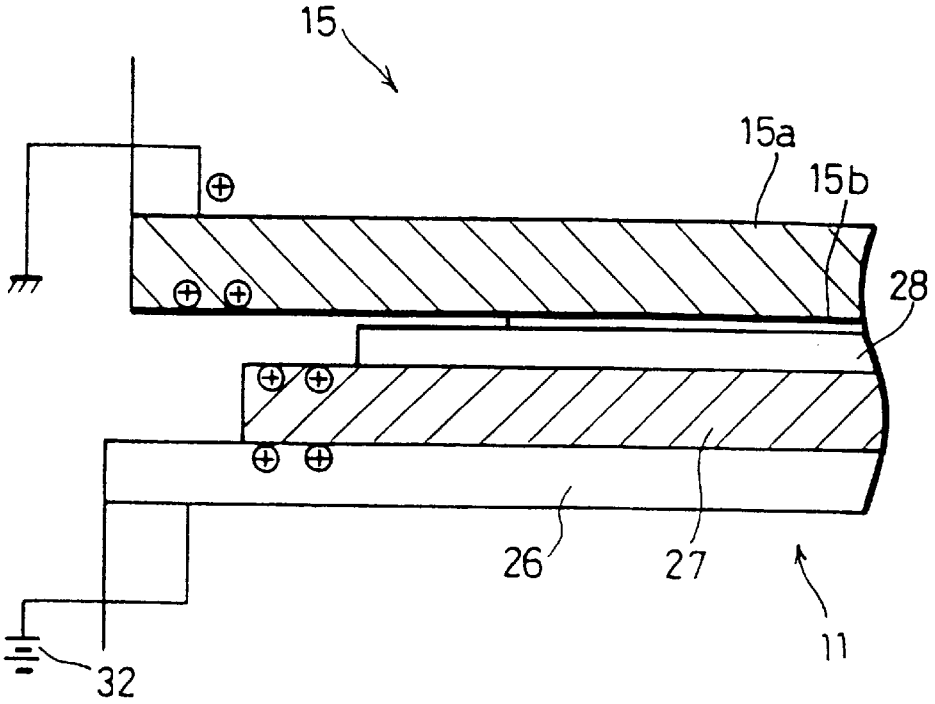
FIG. 5 is an explanatory diagram showing the movement of electrical charge between the above-mentioned transfer drum and photoreceptive drum, and showing this movement of electrical charge when the widths of the layers of the transfer drum are: dielectric layer<semiconducting layer<conductive layer.

This is because, if the layers of the transfer drum 11 are provided as shown in FIG. 5, so that their widths have the relationship conductive layer 26>semiconducting layer 27>dielectric layer 28, there is a risk that the semiconducting layer 27 will touch the grounded aluminum cylinder 15*a* of the photoreceptive drum 15.

When a positive voltage is applied to the conductive layer 26 by the power source 32, a positive charge is induced in the conductive layer 26, and this positive charge moves to the surface of the semiconducting layer 27. At this time, if the semiconducting layer 27 and the grounded aluminum cylinder 15*a* of the photoreceptive drum 15 come into contact, the charge of the semiconducting layer 27 is transferred to the entirety of the aluminum cylinder 15*a*, making it impossible to induce a positive charge in surface of the dielectric layer 28. As a result, the transfer drum 11 is unable to attract the negatively charged toner affixed to the OPC film 15*b*, and poor transfer occurs.

Figure 6:
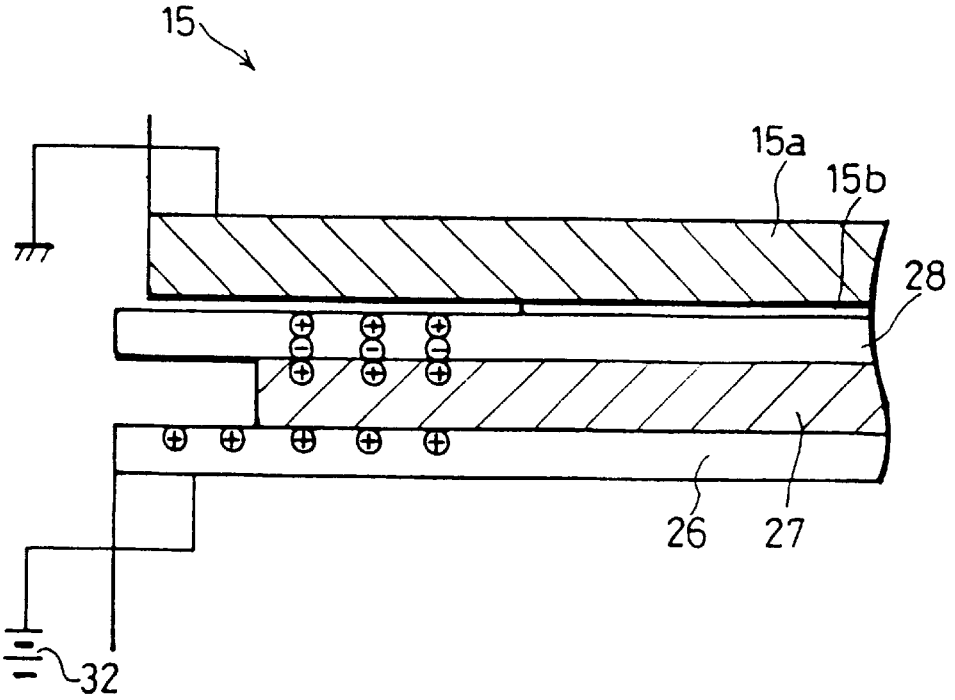
FIG. 6 is an explanatory diagram showing the movement of electrical charge between the above-mentioned transfer drum and photoreceptive drum, and showing this movement of electrical charge when the widths of the layers of the transfer drum are: semiconducting layer<dielectric layer=conductive layer.

Therefore, as shown in FIG. 6, the conductive layer 26 and the dielectric layer 28 are provided with the same width, and the semiconducting layer 27 is made narrower than both of the above. With this structure, the semiconducting layer 27 can be prevented from grounding the aluminum cylinder 15*a*, thus preventing leakage of charge. By this means, the transfer drum 11 is able to attract the negatively charged toner affixed to the OPC film 15*b*, and poor transfer can be eliminated.

The transfer drum 11 is provided with a diameter such that a sheet of transfer paper P can be wrapped thereon without overlapping, i.e., a diameter in accordance with the largest width or length of transfer paper P which can be used in the present image-forming device. By this means, the transfer paper P can be wrapped stably on the transfer drum 11. This improves transfer efficiency, thus enabling improved image quality.

The time constant $\tau$ of the transfer drum 11 is shown by:

$$\tau = CR = \in \cdot \in_0 \cdot \rho$$

Here, R is the resistance of the transfer drum 11, C is the electrostatic capacitance of the transfer drum 11, $\in$ is the dielectric constant of the transfer drum 11, $\in_0$ is the dielectric constant of a vacuum, and $\rho$ is the volume resistivity of the transfer drum 11.

Accordingly, the time constant $\tau$ may be found by (1) finding the volume resistivity $\rho$ using the method of volume-resistance measurement shown in Japanese Industrial Standards K6911, (2) calculating the resistance R, and then (3) finding the electrostatic capacitance C. A practical time constant $\tau$ may be measured by (1) pressing an aluminum cylinder identical to the aluminum cylinder 15*a* to be used in the photoreceptive drum 15 against the transfer drum 11 with the same pressure and in the same position as in actual operating conditions, (2) rotating the transfer drum 11 while applying a voltage, and then (3) stopping the rotation and measuring the surface potential.

The width of the nip where the transfer drum 11 touches the ground roller 12 (the affixing position) can be adjusted by, for example, changing the hardness of the semiconducting layer 27. Further, the time required for a certain point on a sheet of transfer paper P to pass across the nip, i.e., the nip time, is shown by: (width of nip where transfer drum 11 and ground roller 12 touch)/ (speed of rotation of transfer drum 11). Therefore, the nip time can be changed easily by adjusting the contact pressure between the transfer drum 11 and the ground roller 12 by, for example, changing the hardness of the semiconducting layer 27.

On the other hand, if the nip width is held constant, the nip time can be adjusted by changing the speed of rotation of the transfer drum 11. However, if the nip time is increased by slowing the speed of rotation of the transfer drum 11, the transfer efficiency per minute is decreased. Accordingly, in order to change the nip time, it is preferable to adjust the contact pressure between the transfer drum 11 and the ground roller 12 by, for example, changing the hardness of the semiconducting layer 27.

Again, the width of the nip between the transfer drum 11 and the photoreceptive drum 15 (the transfer position) can be adjusted in the same manner as above, by, for example, changing the hardness of the semiconducting layer 27. Further, the nip time required for a certain point on a sheet of transfer paper P to pass across the nip can be easily changed by adjusting the contact pressure between the transfer drum 11 and the photoreceptive drum 15 by, for example, changing the hardness of the semiconducting layer 27.

The structure of the transfer drum 11 explained above can also be applied to an intermediate transfer medium (not shown) . In other words, the present invention can also be applied to an image-forming device provided with an image-carrying body, on the surface of which a toner image is formed; an intermediate transfer medium, which is in contact with the image-carrying body, and to which the toner image formed on the image-carrying body is temporarily transferred; and a transfer means, which transfers to a transfer material the toner image temporarily transferred to the intermediate transfer medium. Accordingly, the following will only explain an image-forming device having a transfer drum 11, but effects equivalent to those of the present embodiment may of course be obtained in an image-forming device having an intermediate transfer medium.

Figure 8:
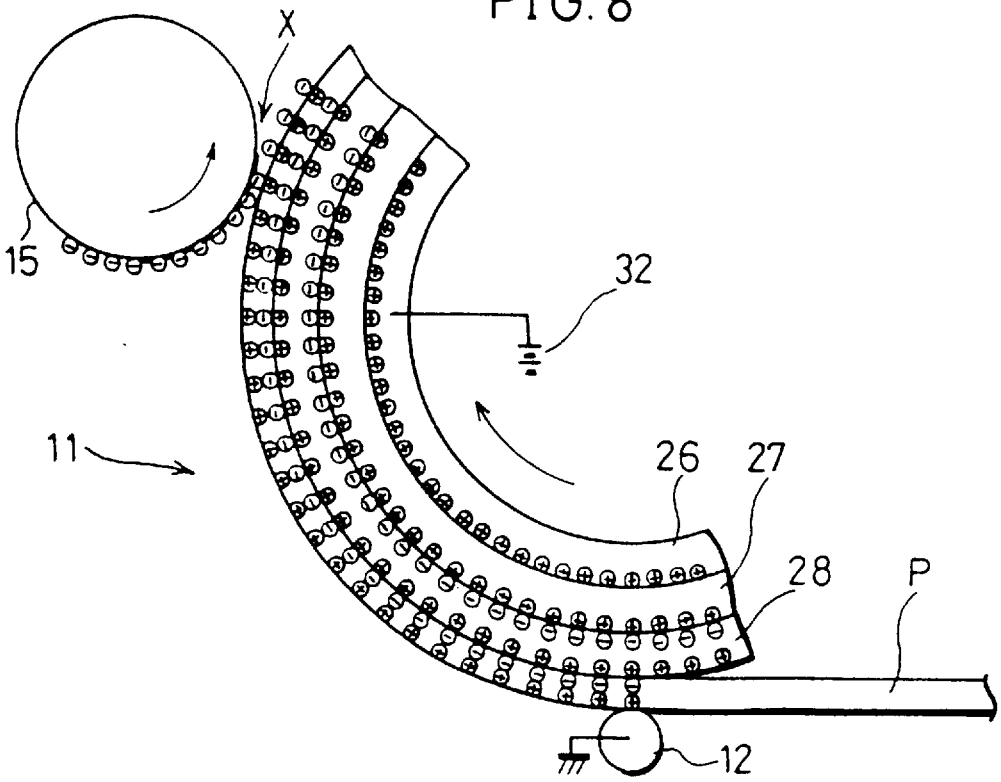
FIG. 8 is an explanatory diagram showing the state of charging in the above-mentioned transfer drum, and showing the situation when a sheet of transfer paper is transported to the transfer point of the transfer drum.
Figure 9:
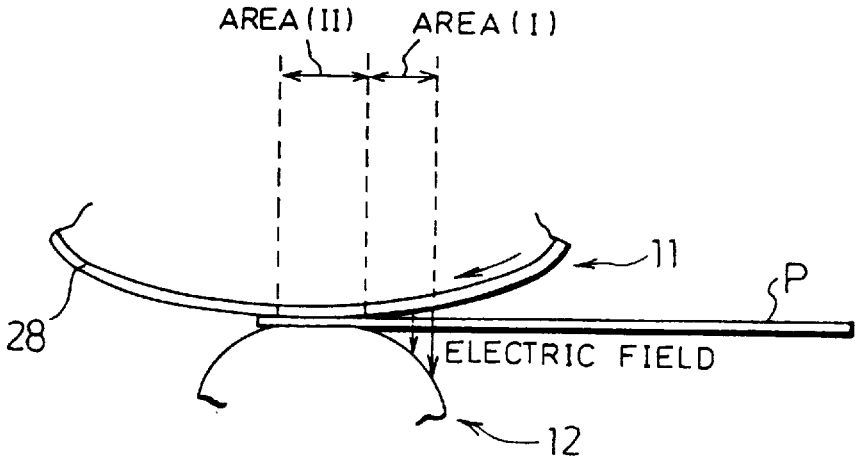
FIG. 9 is an explanatory diagram showing Paschen discharge at the nip area between the above-mentioned transfer drum and a ground roller.
Figure 10:
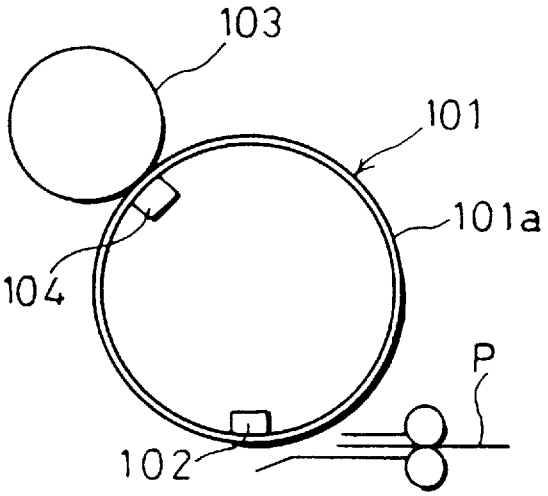
FIG. 10 PRIOR ART
FIG. 10 is a cross-sectional view schematically showing the structure of a conventional image-forming device.
Figure 11:
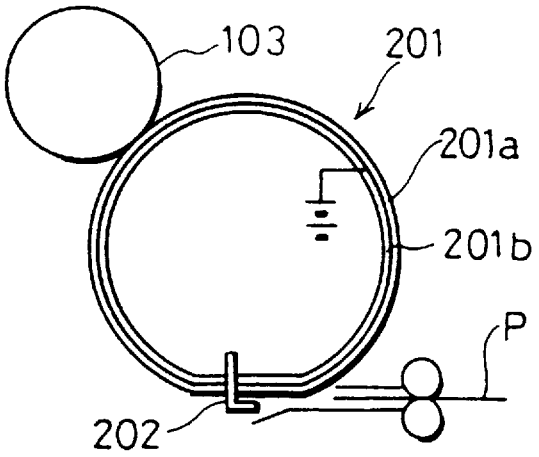
FIG. 11 PRIOR ART
FIG. 11 is a cross-sectional view schematically showing the structure of another conventional image-forming device.
Figure 12:
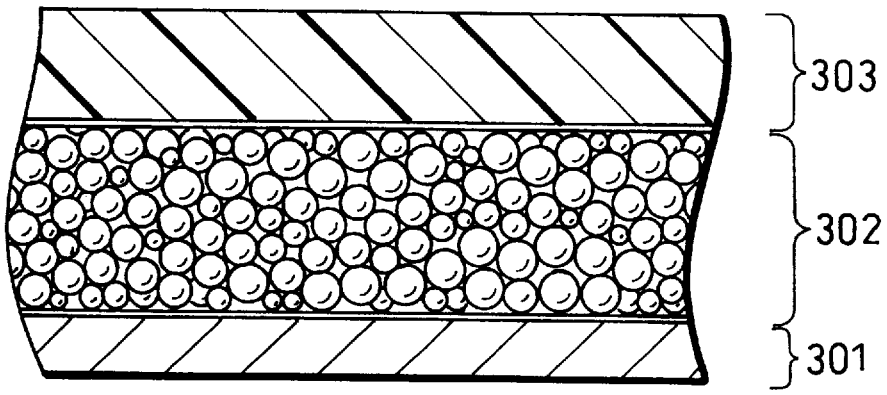
FIG. 12 PRIOR ART
FIG. 12 is a cross-sectional view schematically showing the structure of a dielectric sheet used in a transfer drum provided in a conventional image-forming device.

Next, operations of the transfer drum 11 for affixing the transfer paper P and performing transfer will be discussed with reference to FIGS. 7 through 9. It will be assumed that the power source 32 applies a positive voltage to the conductive layer 26 of the transfer drum 11.

First, operations for affixing a sheet of transfer paper P will be explained. Charging of the dielectric layer 28 using the ground roller 12 is performed primarily by means of Paschen discharge and charge injection. As shown in FIG. 7, a sheet of transfer paper P transported to the transfer drum 11 is pressed against the surface of the dielectric layer 28 by the ground roller 12. At this time, a charge stored in the semiconducting layer 27 is transferred to the dielectric layer 28, inducing a positive charge in the surface thereof. This gives rise to an electric field extending from the transfer drum 11 toward the ground roller 12, as shown in FIG. 9. Due to the rotation of the transfer drum 11 and the ground roller 12, the surface of the transfer drum 11 is uniformly charged.

As a point on the surface of the ground roller 12 and a point on the surface of the dielectric layer 28 of the transfer drum 11 approach one another, the electric field at the place where the dielectric layer 28 and the ground roller 12 are closest, i.e., at the nip, increases in strength, atmospheric dielectric breakdown occurs, and there is a discharge from the transfer drum 11 to the ground roller 12 at the area (I), i.e., a Paschen discharge occurs.

Then, after this discharge, charge injection from the ground roller 12 to the transfer drum 11 occurs at the nip therebetween, i.e., at area (II), and a positive charge is stored in the surface of the transfer drum 11. In other words, due to the Paschen discharge and the accompanying charge injection, a negative charge is stored in the inner side of the transfer paper P, i.e., the side which touches the dielectric layer 28. As a result, the transfer paper P is electrostatically affixed to the transfer drum 11. As long as the voltage applied is stable, there is no unevenness in the attraction of the transfer paper P for the transfer drum 11, and the transfer paper P can be stably affixed to the transfer drum 11.

Figure 7:
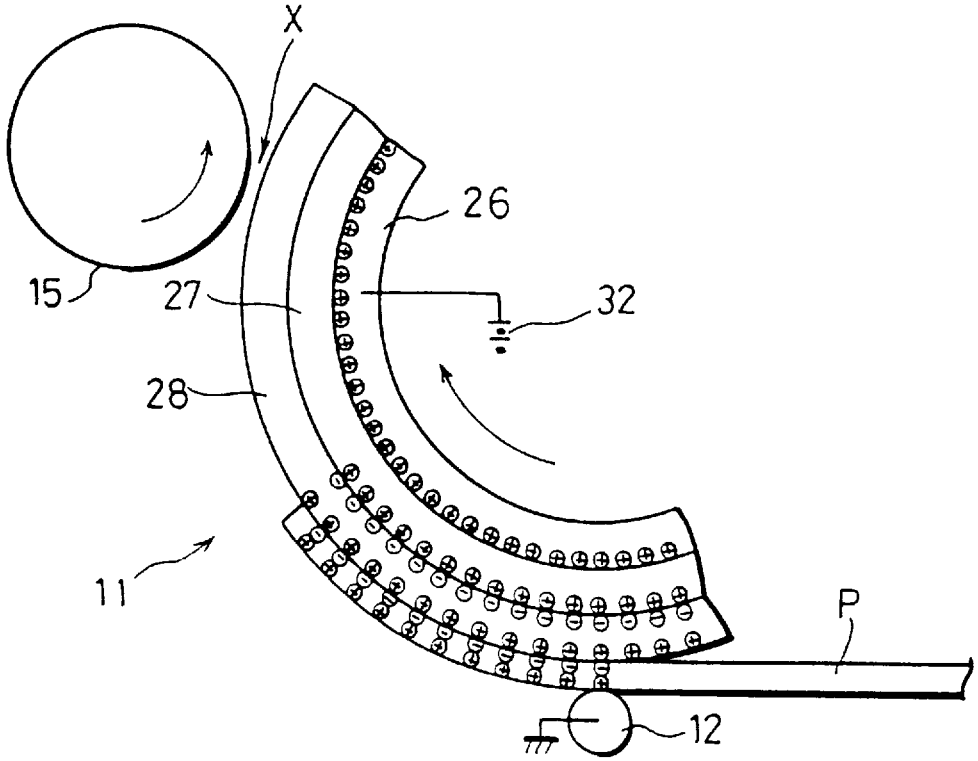
FIG. 7 is an explanatory diagram showing the state of charging in the above-mentioned transfer drum, and showing the situation when a sheet of transfer paper is initially transported to the transfer drum.

The transfer paper P, positively charged on its outer side, is then transported by the rotation of the transfer drum 11 in the direction of the arrow to the toner image transfer point X (see FIG. 7).

Next, the operations of transfer to the transfer paper P will be explained. As shown in FIG. 8, negatively charged toner is affixed to the surface of the photoreceptive drum 15. Accordingly, when the transfer paper P, the surface of which is positively charged, is transported to the transfer point X, the toner is attracted to the surface of the transfer paper P due to the potential difference between the positive charge of the surface of the transfer paper P and the negative charge of the toner, and the toner image is transferred.

As discussed above, the semiconducting layer 27 of the transfer drum 11 has a foam portion with foam particles which increase in diameter toward the conductive layer 26. Therefore, the inner portion thereof (the portion toward the conductive layer 26) with large foam particles can provide a desired elasticity, and the outer portion thereof (the portion touching the transfer paper P) with small foam particles can provide a desired smoothness.

Accordingly, since both elasticity and surface smoothness of the transfer drum 11 can be obtained, the transfer paper P can be held stably in both high-temperature, high-humidity and in low-temperature, low-humidity operating conditions, and good attraction of the transfer paper P for the transfer drum 11 can be maintained. As a result, transfer performance is improved, and thus poor transfer of the toner image, distortion of printed characters, deterioration of image quality, etc. can be avoided with certainty. Since the transfer paper P can be held stably, a stable device not prone to breakdown can be provided. Further, since the image-forming device can be realized by a simple structure like that outlined above, the size of the device can also be reduced.

Furthermore, since affixing and transfer in the present embodiment are not performed by means of charge injection by atmospheric discharge (as was the case in the past) but by inducing a charge, application of a low voltage to the conductive layer 26 is sufficient, and voltage control is easy. The results of various experiments show that a voltage of +3 kV or less is suitable for application to the conductive layer 26, and that good charging and transfer can be performed with, more preferably, a voltage of +1.5 kV. Further, since in this case less driving energy is required, unevenness in the applied voltage can be eliminated.

Furthermore, unlike the case of atmospheric discharge, there is no influence from environmental factors such as humidity and temperature, and thus the voltage applied to the transfer drum 11 can be maintained at a constant level, and unevenness in the surface potential of the transfer drum 11 can be eliminated. As a result, poor affixing of the transfer paper P, distortion of printed characters, etc. can be eliminated, and image quality can be improved. In addition, since the surface of the transfer drum 11 can be charged more stably than in the case of the conventional atmospheric discharge, affixing of and transfer to the transfer paper P can be performed stably.

Again, since voltage must be applied at only one place, unlike in the conventional case in which voltage is applied to each charger, the structure of the device as a whole can be streamlined, and the costs of manufacturing can be reduced. Further, since the transfer drum 11 is charged by contact charging, even if there are scratches or nicks in the surface of the transfer drum 11, the electric field area does not change, and the electric field balance is not disturbed at the scratch or nick. As a result, white spots or other poor transfer does not occur, thus improving transfer efficiency.

The following will explain, with reference to FIG. 1, three embodiments of a method of manufacturing the dielectric sheet to be used as the surface of the transfer drum 11 of the image-forming device according to the present invention.

(FIRST EMBODIMENT)

In the present embodiment, an example will be explained in which EPDM is used for the dielectric polymer. First, a mixture containing, by weight, for 100 parts EPDM, 8 to 10 parts zinc oxide, 2 parts of a metallic soap such as zinc stearate, 10 parts foaming agent, 35 parts carbon black, 40 parts paraffin oil, 25 parts fortified carbon, and 3 parts vulcanizing promoter, is stirred and heated in a stirring device prepared in advance, and is then extruded from an injection mold and injected into a sheet mold, thus forming the mixture into a sheet.

EPDM is a substance produced by copolymerization of a monomer composite containing appropriate amounts of ethylene, propylene, and a third component (for example dicyclopentadiene, ethylidene norbornene, 1,4-hexadiene, etc.). The EPDM to be used as base material in the present embodiment should preferably be one produced by copolymerization of a monomer composite containing, by weight, 5 to 95 parts ethylene, 5 to 95 parts propylene, and 0 to 50 parts by iodine value of the third component.

Good dispersion of carbon black can be obtained if a proportion by weight of 1 to 70 parts carbon black to 100 parts EPDM is used. The carbon black used is channel black or a furnace black such as ISAF (Intermediate Super Abrasion Furnace), HAF (High Abrasion Furnace), GPF (General Purpose Furnace), or SRF (Semi Reinforcing Furnace).

When a foaming agent is used, good foaming can be obtained by including, by weight, 2.0 parts silicon-based surfactant, such as polydialkyl siloxane, a polysiloxane-polyalkylene oxide block co-polymer, etc.

Alternatively, when a foaming agent is not used, a foaming group can be formed within the EPDM itself by means of a chemical reaction using one or more of propylene oxide, ethylene oxide, polyether-polyol, tolylenediisocyanate, 1-4 butanediol, a silicon-based surfactant, and di-n-butyltindilaurate.

Next, after the foregoing mixture is formed into a sheet, the side of the sheet which is to touch the conductive layer 26 is kept at 100° C. to 150° C., and the opposite side kept at a normal temperature of approximately 50° C., for a predetermined duration (10 to 30 minutes, for example). This promotes foaming, and a dielectric sheet is obtained. As a result, the dielectric sheet has a structure in which the diameter of foam particles gradually increases toward the side which touches the conductive layer 26. In the present embodiment, the foaming ratio is 600% for the foam particles of largest diameter.

Here, a conductive adhesive is coated in advance on the outer surface of the conductive layer 26, which is a metal cylinder of, for example, aluminum. Then, the dielectric sheet is wrapped around the conductive layer 26 so that the side with larger foam particles touches the conductive layer 26, and allowed to dry. By means of this drying, the conductive layer 26 and the dielectric sheet will be attached with sufficient adhesive strength. Incidentally, although not shown in the drawings, a dielectric layer 28 made of, for example, PVDF, may be provided, as necessary, on the upper surface of the semiconducting layer 27 (see FIG. 3).

A semiconducting layer 27 in a transfer drum 11 (see FIG. 2) provided according to the foregoing method had a thickness of 3000 μm, a dielectric constant of 12, a sponge hardness of 70°, and its surface was a skin layer in the form of a film. Further, in the 3000 μm-thick semiconducting layer 27, the portion with large foam particles (including foam particles 500 μm or more in diameter) was 2800 μm thick, and the portion with small foam particles was 200 μm thick. As a result, the inner portion of the semiconducting layer 27 was able to provide elasticity, and the outer surface portion was able to provide smoothness.

If the semiconducting layer 27 is formed so that foam particles will be 500 μm in diameter, there will actually be some approximately 1 mm in diameter. However, since there will be very few foam particles of this size, the influence of these large particles can in effect be ignored.

Accordingly, if the transfer drum 11 is provided using the dielectric sheet described above, a transfer drum 11 with both elasticity and smoothness can be provided. Thus the transfer paper P can be held stably, and good attraction of the transfer paper P for the transfer drum 11 can be maintained. As a result, since transfer performance is improved, poor transfer of the toner image, distortion of printed characters, impairment of image quality, etc. can be avoided with certainty. Since the transfer paper P can be held stably, a stable device not prone to breakdown can be provided. Further, since the dielectric sheet can be manufactured by means of the comparatively simple method outlined above, the cost of manufacturing the dielectric sheet can be reduced, and accordingly the cost of the device as a whole can be reduced.

(SECOND EMBODIMENT)

In the present embodiment, an example using polyurethane for the dielectric polymer will be explained. First, for 100 parts by weight of polyurethane, 5 parts carbon black (in the present embodiment, HAF carbon black), 8 to 10 parts zinc oxide, 2 parts of a metallic soap such as zinc stearate, 10 parts foaming agent, 40 parts paraffin oil, 25 parts fortified carbon, and 3 parts vulcanizing promoter are mixed together.

With regard to the polyurethane used, soft polyurethane foam or polyurethane elastomer are suitable. Alternatively, EPDM, urethane, nylon, silicone, PET, PTFE, PVDF, natural rubber, nitryl-butadiene rubber, chloroprene rubber, styrene-butadiene rubber, butadiene rubber, ethylene-propylene rubber, isopropylene rubber, polynorbornene rubber, etc. may be used. Again, a blend of appropriate amounts of these materials may also be used.

The carbon black included may be channel black or a furnace black such as ISAF, GPF, or SRF instead of the above-mentioned HAF carbon black, and the amount included may be from 0.5 to 15 parts by weight. The carbon black included had a nitrogen adsorption specific surface area of from 20 $m^2/g$ to 130 $m^2/g$ and an oil absorption of DBP (dibutyl phthalate) of from 60 ml/100 g to 120 ml/100 g.

When, as above, a foaming agent is used, good foaming can be obtained by including, by weight, 2.0 parts silicon-based surfactant, such as polydialkyl siloxane, a polysiloxane-polyalkylene oxide block copolymer, etc.

Alternatively, when a foaming agent is not used, a foaming group can be formed within the polyurethane itself by means of a chemical reaction using one or more of propylene oxide, ethylene oxide, polyether-polyol, tolylenediisocyanate, 1-4 butanediol, a silicon-based surfactant, and di-n-butyltindilaurate.

Next, blow foaming by heating is performed, as follows. The mixture of the above materials is first injected into and foamed by a foaming and injection device made by the Mondomix company. Next, the foamed mixture is injected into a metal injection/extrusion mold, heated at 80° C. to 120° C., and extruded. At this time, a cylindrical metal mold with an inner diameter slightly larger than the extrusion hole of the metal injection/extrusion mold is prepared adjacent to the extrusion hole, and the mixture is extruded into this cylindrical metal mold.

Then, extrusion is stopped when a predetermined length of the mixture has been extruded, or a predetermined length of the extruded mixture is cut off with a cutter, etc., and the interior of the cylindrical metal mold is then heated, foaming the dielectric polymer and producing a cylindrical dielectric sheet. Heating for from 5 minutes to 100 minutes is preferable. The cylindrical dielectric sheet may also be produced at low temperature by maintaining the interior of the cylindrical metal mold at 60° C. for 3 hours, and then at 80° C. for a further 10 hours.

Next, the inner surface of the cylindrical dielectric sheet is attached to the conductive layer 26, which has been coated with conductive adhesive in advance, and allowed to dry. By means of this drying, the conductive layer 26 and the semiconducting layer 27 (the dielectric sheet) will be attached with sufficient adhesive strength. Incidentally, although not shown in the drawings, a dielectric layer 28 made of, for example, PVDF, may be provided, as necessary, on the upper surface of the semiconducting layer 27.

As discussed above, in the present embodiment, since the dielectric polymer is foamed by heating the inner side of the cylindrical metal mold, foaming is more promoted toward the interior of the cylindrical metal mold than toward its exterior. As a result, the cylindrical dielectric sheet obtained has a foam portion with foam particles which gradually decrease in diameter from the interior towards the exterior of the cylindrical metal mold. By this means, a desired elasticity can be provided by the portion with large foam particles, and a desired surface smoothness by the portion with small particles.

Accordingly, with the foregoing structure, a transfer drum 11 with both elasticity and surface smoothness can be provided. Thus the transfer paper P can be held stably, and good attraction of the transfer paper P for the transfer drum 11 can be maintained. As a result, since transfer performance is improved, poor transfer of the toner image, distortion of printed characters, impairment of image quality, etc. can be avoided with certainty. Further, since the transfer material can be held stably, a stable device not prone to breakdown can be provided.

In addition, using the foregoing method, portions with foam particles of differing diameter can be formed merely by heating the inner side of the cylindrical metal mold, and a desired dielectric sheet can be obtained comparatively easily.

Incidentally, it is also possible to integrally provide the semiconducting layer 27 and a conductive metal core (the conductive layer 26) by injection molding. In this case, the metal core is placed in the center of a previously prepared metal mold, and the mixture is poured into the metal mold as above, and integral formation is completed by vulcanization by heating for about 100 minutes to 160 minutes.

(THIRD EMBODIMENT)

In the present embodiment, at least one kind of ionic dielectric material is added to a mixture prepared as in the first or second embodiment. Examples of such ionic dielectric materials are inorganic ionic dielectric materials such as sodium perchlorate, calcium perchlorate, and sodium chloride, or organic ionic dielectric materials such as denatured fat dimethylethyl ammonium ethosulfate, stearyl ammonium acetate, lauryl ammonium acetate, and octadecyltrimethyl ammonium perchlorate.

Then, after foaming the mixture using the method according to the first or second embodiment, the mixture is introduced into a mold of a desired shape, and maintained at 80° C. for about 12 hours, thus producing a dielectric sheet.

In the present embodiment, an ionic dielectric material is added to a mixture prepared as in the first or second embodiment. Therefore, unevenness in resistance will not arise in the dielectric sheet, and a dielectric sheet can be manufactured which is more uniform than if an ionic dielectric material is not used.

Here, in order to investigate the electrical characteristics of dielectric sheets prepared according to each of the foregoing embodiments, transfer drums 11 having as their surface layers the dielectric sheets prepared according to the first, second, and third embodiments, respectively, were prepared, and the electrical resistance of each dielectric sheet was measured as follows.

Using a metal cylinder made of SUS (Stainless Steel) 60 mm in diameter as a rotating counter electrode, and a Trek model 610 C power source, a voltage of 100V was applied to the metal cylinder, and the resistance was measured. The rotation speed of the transfer drum 11 was 1 rotation/sec, and the continuous time electrified was 10 hours. The environmental conditions of measurement were a temperature of 25° C. and a relative humidity of 70%.

The results of the measurement showed that the dielectric sheets prepared according to each of the first through third embodiments had a stable resistance of between $9\times10^6\Omega$ and $2\times10^7\Omega$.

If, along with the carbon black added to the dielectric polymer, an ionic dielectric material such as sodium perchlorate or tetraethyl ammonium chloride, a surfactant such as dimethyl polysiloxane or polyoxyethylene lauryl ether, etc., are added in the amount of 0.1 to 10 parts by weight to 100 parts by weight of the dielectric polymer, an even more uniform distribution of the carbon black can be obtained. As a result, it becomes even easier to electrically adjust the resistance of the dielectric polymer, and unevenness in the resistance of the dielectric polymer is even easier to reduce.

The concrete embodiments and examples of implementation discussed in the foregoing detailed explanations of the present invention serve solely to illustrate the technical details of the present invention, which should not be narrowly interpreted within the limits of such concrete examples, but rather may be applied in many variations without departing from the spirit of the present invention and the scope of the patent claims set forth below.

What is claimed is:

1. An image-forming device comprising:

an image-carrying body, upon which a toner image is formed;

a transfer medium, which transfers the toner image formed upon said image-carrying body to a transfer material by bringing the transfer material into contact with said transfer medium; and affixing means, provided at a perimeter of said transfer medium, which electrically affix and hold the transfer material to said transfer medium;

said transfer medium being made up of at least a semiconducting layer and a conductive substrate supporting said semiconducting layer, said semiconducting layer having a foam portion with foam particles which increase in diameter toward said conductive substrate.

2. An image-forming device comprising:

an image-carrying body, upon which a toner image is formed;

an intermediate transfer medium, to which the toner image formed upon said image-carrying body is temporarily transferred; and transfer means, which electrostatically transfer to a transfer material the toner image temporarily transferred to said intermediate transfer medium;

said intermediate transfer medium being made up of at least a semiconducting layer and a conductive substrate supporting said semiconducting layer, said semiconducting layer having a foam portion with foam particles which increase in diameter toward said conductive substrate.

3. The image-forming device set forth in claim 1, wherein:

said affixing means affix the transfer material in response to inducing of an electric charge.

4. The image-forming device set forth in claim 1, wherein:

the diameter of the foam particles of said foam portion is from 100 $\mu$m to 500 $\mu$m.

5. The image-forming device set forth in claim 1, wherein:

the thickness of said semiconducting layer is from 300 $\mu$m to 600 $\mu$m.

6. The image-forming device set forth in claim 1, wherein:

the dielectric constant of said semiconducting layer is 10 or more.

7. The image-forming device set forth in claim 1, wherein:

said semiconducting layer includes a foaming agent and one of: ethylene-propylene-diene co-polymer, polyurethane, urethane, nylon, silicone, polyethylene terephthalate, polytetrafluoroethylene, polyvinylidene fluoride, natural rubber, nitryl-butadiene rubber, chloroprene rubber, styrene-butadiene rubber, butadiene rubber, ethylene-propylene rubber, isopropylene rubber, and polynorbornene rubber.

8. The image-forming device set forth in claim 7, wherein:

said foaming agent is a nitrogen-based foaming agent.

9. The image-forming device set forth in claim 7, wherein:

said foaming agent includes a silicon-based surfactant.

10. The image-forming device set forth in claim 1, wherein:

said semiconducting layer includes a foaming group formed by a chemical reaction using one or more of: propylene oxide, ethylene oxide, polyether-polyol, tolylenediisocyanate, 1-4 butanediol, a silicon-based surfactant, and di-n-butyltindilaurate.

11. The image-forming device set forth in claim 1, wherein:

said semiconducting layer includes conductive particles.

12. The image-forming device set forth in claim 11, wherein:

said conductive particles are at least one of: carbon, carbon black, and titanium oxide.

13. The image-forming device set forth in claim 12, wherein:

said carbon black is furnace black or channel black.

14. The image-forming device set forth in claim 1, wherein:

said semiconducting layer includes ionic conductive material.

15. The image-forming device set forth in claim 14, wherein:

said ionic conductive material is at least one of: sodium perchlorate, calcium perchlorate, sodium chloride, denatured fat dimethylethyl ammonium ethosulfate, stearyl ammonium acetate, lauryl ammonium acetate, and octadecyltrimethyl ammonium perchlorate.

16. The image-forming device set forth in claim 1, wherein:

said image-carrying body has a photoreceptive cylinder, and said transfer medium is further provided with a dielectric layer;

said dielectric layer being wider than said photoreceptive cylinder, and said photoreceptive cylinder being wider than an effective transfer width of said image-carrying body, and said effective transfer width being wider than an effective image width of said image-carrying body.

17. The image-forming device set forth in claim 16, wherein:

the widths of said conductive substrate and said dielectric layer are equal, and the width of said semiconducting layer is smaller than the respective widths of said conductive substrate and said dielectric layer.

18. The image-forming device set forth in claim 1, wherein:

said transfer medium is provided as a cylindrical transfer drum; and the diameter of said transfer drum is set so that said transfer drum has a circumference corresponding to the greatest width of the transfer material.

19. A method of manufacturing a dielectric sheet to be used as a surface of a transfer medium which brings a transfer material electrically affixed and held to the surface of said transfer medium into contact with an image-carrying body, thus transferring to the transfer material a toner image formed upon said image-carrying body, said method comprising the steps of:

(a) heating a dielectric polymer containing a foaming group or a foaming agent, so as to form a sheet; and (b) heating each side of the formed sheet at a different temperature, so as to foam the dielectric polymer.

20. The method of manufacturing a dielectric sheet set forth in claim 19, further comprising the step of:

adding carbon black to the dielectric polymer.

21. The method of manufacturing a dielectric sheet set forth in claim 19, further comprising the step of:

adding an ionic dielectric material to the dielectric polymer.

22. The method of manufacturing a dielectric sheet set forth in claim 19, further comprising the step of:

adding a silicon-based surfactant to the dielectric polymer.

23. A method of manufacturing a dielectric sheet to be used as a surface of a transfer medium which brings a transfer material electrically affixed and held to the surface of said transfer medium into contact with an image-carrying body, thus transferring to the transfer material a toner image formed upon said image-carrying body, said method comprising the steps of:

(a) extruding a dielectric polymer containing a foaming group or a foaming agent in the form of a cylinder; and (b) heating an inner surface of the cylinder, so as to foam the dielectric polymer.

* * * * *